US006032432A

United States Patent [19]

Patti

[11] Patent Number: 6,032,432

[45] **Date of Patent: *Mar. 7, 2000**

[54] INTERLOCKING MODULAR PARTS FOR LIGHT FIXTURES

[75] Inventor: Anthony G. Patti, San Gabriel, Calif.

[73] Assignee: Genlyte Thomas Group LLC, Louisville, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 08/781,624

[22] Filed: Jan. 9, 1997

[51] Int. Cl.[7] ..... F21S 3/02

[52] U.S. Cl. ..... 52/732.1; 29/428; 40/564; 52/28; 362/356; 362/361; 362/370

[58] Field of Search ..... 52/28, 730.1, 731.2, 52/732.1, 732.2, 732.3, 731.3, 731.4; 362/147, 151, 223, 224, 355, 356, 361, 362, 367, 368, 370; 40/564; 29/428

[56] References Cited

U.S. PATENT DOCUMENTS

| | | | |
|---|---|---|---|
| 83,226 | 10/1868 | Walters et al. | 52/731.4 |
| 965,101 | 7/1910 | Gareinkel | 52/730.1 |
| 1,210,333 | 12/1916 | Kyle | 52/731.4 |
| 3,256,671 | 6/1966 | Handley | 52/731.2 |
| 3,969,849 | 7/1976 | Franklin | 52/28 |
| 4,189,709 | 2/1980 | Gosswiller | 362/362 |
| 4,211,179 | 7/1980 | Saunders | 52/732.3 |
| 4,338,653 | 7/1982 | Marrero | 362/147 |
| 4,411,116 | 10/1983 | Maillero et al. | 52/28 |
| 4,551,792 | 11/1985 | Hoke et al. | 362/362 |
| 4,858,088 | 8/1989 | Agabekov | 362/223 |
| 5,222,344 | 6/1993 | Johnson | 52/731.3 |

*Primary Examiner*—Michael Safavi
*Attorney, Agent, or Firm*—Hill & Simpson

[57] ABSTRACT

A modular panel and method for constructing light fixtures. The modular panel includes an elongated main panel with a curved cross section. The panel is preferably manufactured using an extrusion process. The side edges of the panel feature a pair of spaced-apart lips defining an elongated slot or receiving area for mateably accommodating a cooperating side edge of an adjacent part or panel for a tongue-in-groove connection. The panel has evenly spaced fins along the surface to provide structural integrity as well as to scatter light passing through the panel. Multiple panels being assembled with adjacent intermediate adjoining panels forming a housing having a closed cross section.

9 Claims, 5 Drawing Sheets

FIG. 7
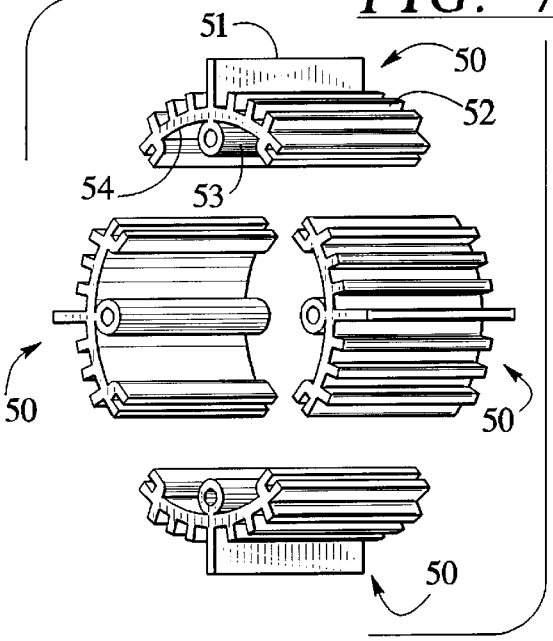
FIG. 14
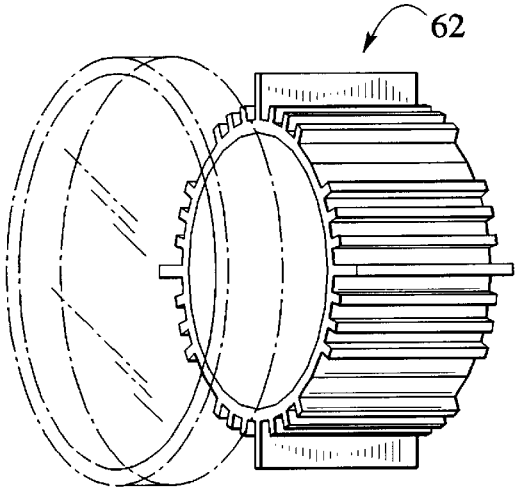
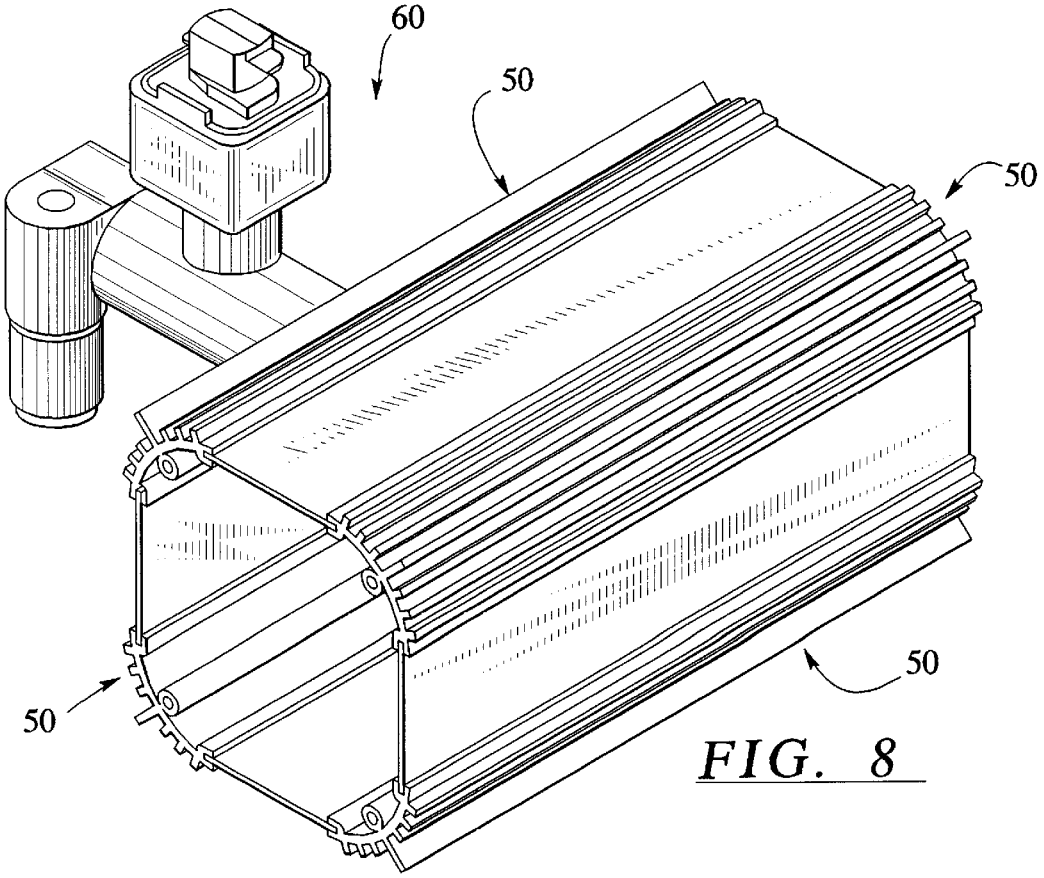
FIG. 8

FIG. 9
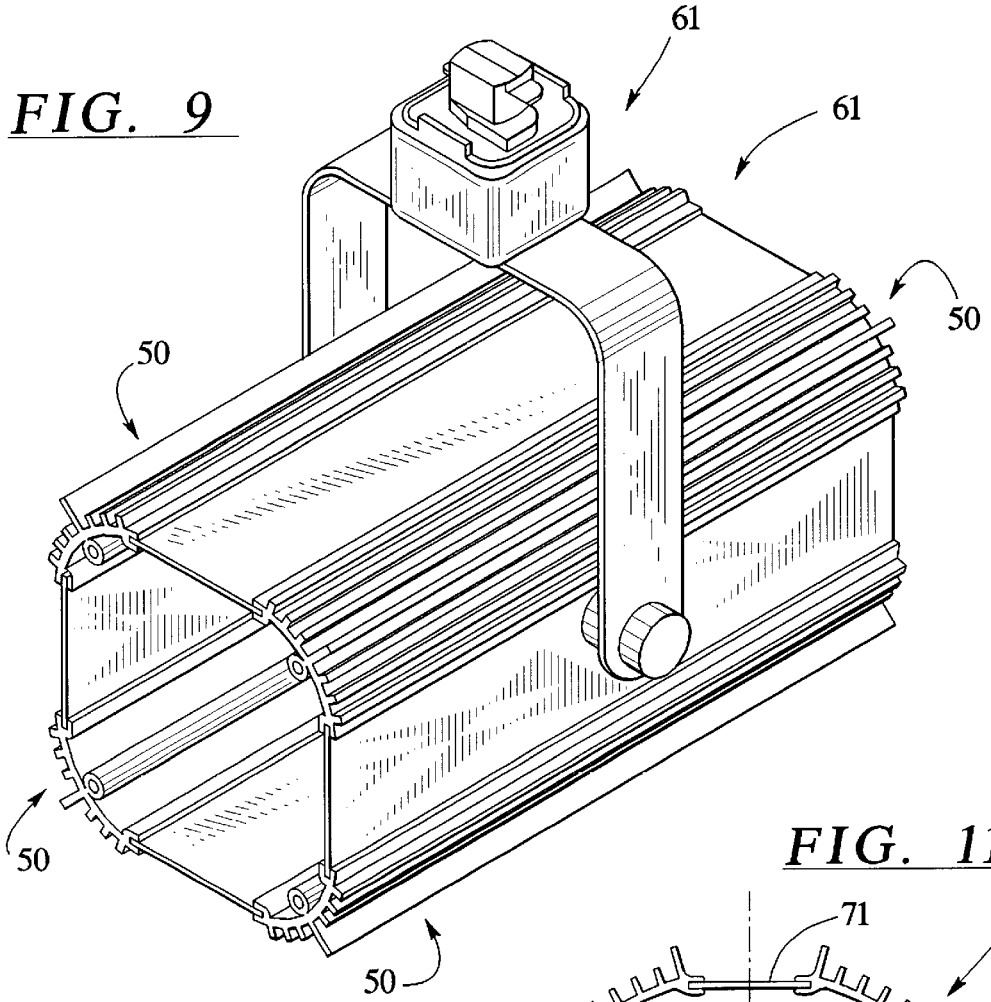
FIG. 11
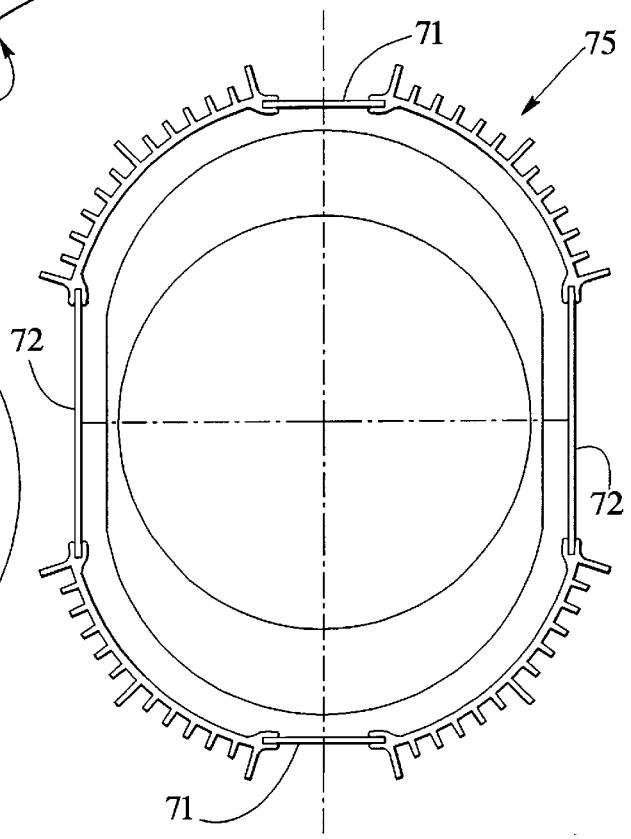
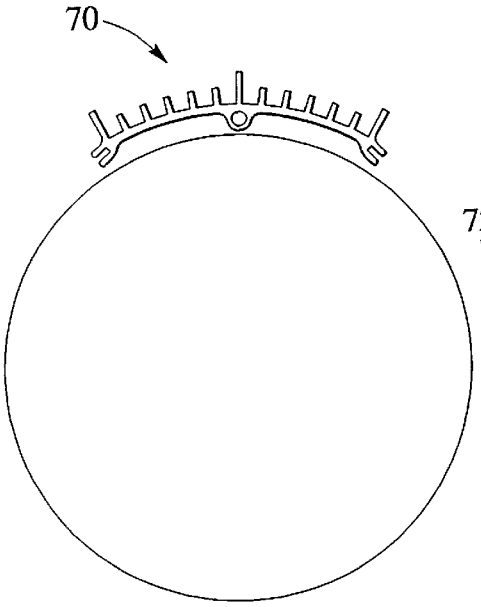
FIG. 10

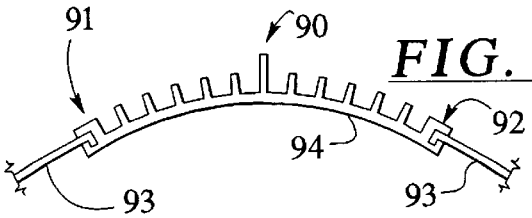
FIG. 15
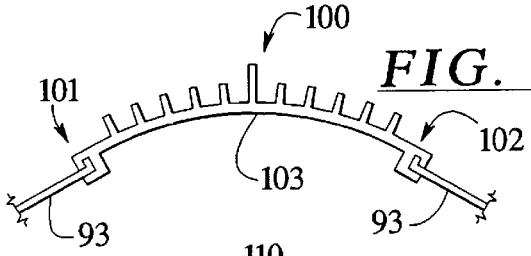
FIG. 16
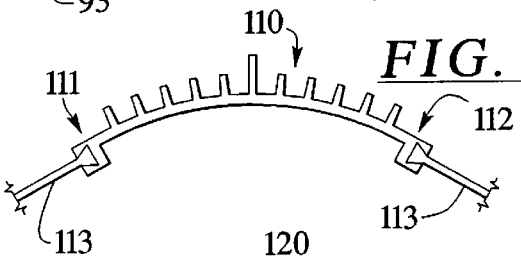
FIG. 17
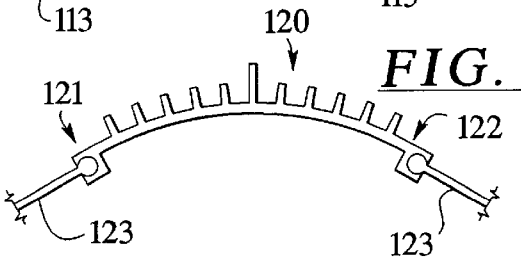
FIG. 18
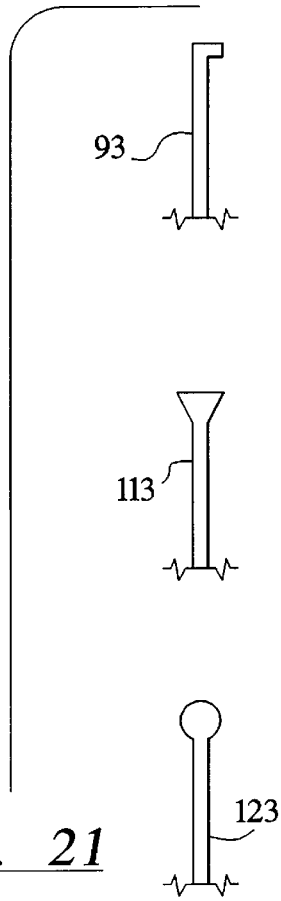
FIG. 21
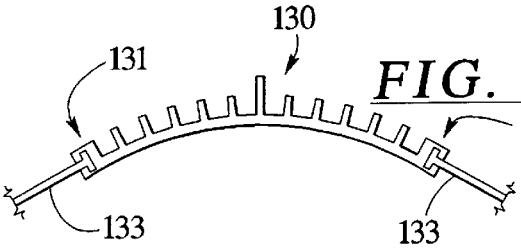
FIG. 19
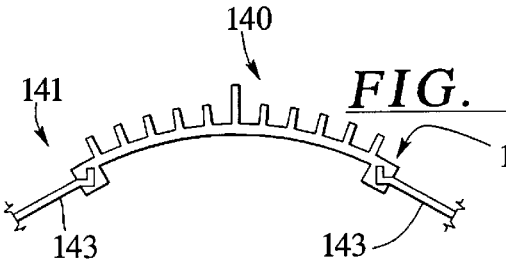
FIG. 20
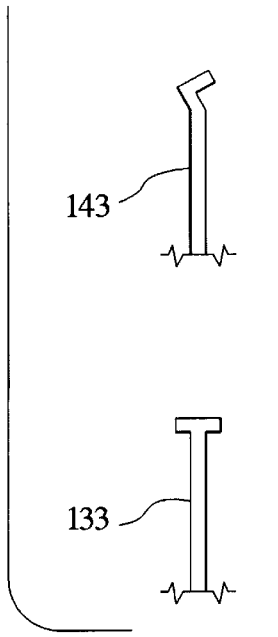

INTERLOCKING MODULAR PARTS FOR LIGHT FIXTURES

FIELD OF THE INVENTION

The present invention relates generally to light fixtures and the manufacture of light fixtures. More specifically, the present invention relates to interlocking modular parts for light fixtures and methods of manufacturing light fixtures using extruded, interlocking modular parts.

BACKGROUND OF THE INVENTION

Many light fixtures are fabricated out of extruded or injection-molded components including housings and lenses. By manufacturing light fixtures from extruded and/or injection-molded components, manufacturers are able to offer the consumer attractive light fixtures at relatively low cost.

As extruded and injection-molded light fixtures have been received with increasing acceptance by consumers, consumers have also demanded a wider variety of styles. However, offering a wider variety of styles negatively impacts the economies of scale for the manufacturers. Specifically, in the past, manufacturers have been required to build new dies or new molds for each housing shape, size and style and for each lens shape, size and style.

Therefore, manufacturers are presented with a dilemma In order to satisfy consumer demand for a wide variety of styles, manufacturers are pressured to expand their product line to include the wide variety of styles desired by the consumer. However, in order to keep material costs down, manufacturers must find a way to expand their product lines without the necessity of designing and building new tooling for each new style or, at least, manufacturers must find a way to limit the tooling needs for each new style or design.

Further, in addition to the high cost, the need to design and build new dies and molds takes time and therefore the introduction of a new design a style is often delayed while a new die or mold is being designed and built. Hence, a large part of the time it takes to bring a new design into the market place is consumed by the design and construction of new dies and/or molds. Therefore, one way to shorten the time it takes to introduce a new design or style would be to limit the need to build new dies or molds for each new design or style.

Accordingly, in the low end consumer products lighting market, there is a need for a way to expand product lines to include new designs and styles while, at the same time, limiting the tooling needs for the new designs and styles.

SUMMARY OF THE INVENTION

The present invention addresses the above-described need by providing interlocking modular components for the construction of light fixtures and a method for incorporating modular components in the construction of light fixtures. By incorporating the interlocking modular components and methods of the present invention, manufacturers will be able to expand their product lines in terms of the number of styles and sizes available without necessarily expanding their tooling needs.

Specifically, a light fixture made in accordance with the present invention includes a plurality of modular panels. Each modular panel is connected between adjacent parts of light fixtures utilizing one of several interlocking mechanisms. The modular panels include an elongated main panel that includes two opposing elongated side edges.

In an embodiment, each side edge features a pair of spaced-apart lips that extend along the length of each side edge and define an elongated receiving area or groove between the spaced-apart lips for mateably receiving a tongue or shaped elongated edge of an adjacent part or structure.

In an embodiment, each side edge of the elongated main panel includes two inwardly-extended spaced-apart lips that extend along the length of each side edge to define an inwardly-extending elongated groove for receiving an outwardly-extending tongue of an adjacent part or structure.

In an embodiment, each side edge of the elongated main panel includes a rounded slot for receiving and locking onto a bead disposed on an adjacent part or structure.

In an embodiment, the modular panels of the present invention are slidably connected to adjacent panels or parts.

In an embodiment, the modular panels of the present invention are connected to adjacent parts or structures using a press fit attachment mechanism.

Examples of the adjacent parts are structures which are attached to the modular panels include flat panels or similar parts of varying sizes. In a preferred embodiment, the modular panels are curved and may be used for corners or curved surfaces of the light fixture. By providing inexpensive flat panels of varying sizes and connecting those panels between the curved modular panels, light fixtures of varying geometries can be provided. Further, a structure may also be provided in accordance with the present invention that consists of four (4) curved modular panels connected together to form a light fixture housing with a round cross section.

In an embodiment, the modular panel of the present invention includes a plurality of outwardly-extending ribs or fins that extend along the length of the panel.

In an embodiment, the modular panel of the present invention presents a smooth exterior surface.

In an embodiment, the modular panel of the present invention includes an inside surface which includes a hollow rib extending along the length of the inside surface. The hollow rib adds strength to the modular panel structure and can also serve as a means for attaching an end plate or similar structure to the ends of the modular panels.

In an embodiment, the inside surface of the modular panels may also include a pair of opposing brackets for accommodating a cross beam extending between one modular panel and another modular panel. The cross beams may be provided for structural support for the light fixture and also may be provided to support a ballast, wiring or other functional parts of the light fixture.

In an embodiment, four (4) modular curved panels of the present invention are used at four (4) corners of a rectangular light fixture structure.

In an embodiment, four (4) curved modular panels of the present invention are used in an oval-shaped light fixture structure.

In an embodiment, four (4) curved modular panels of the present invention are connected together for a light fixture structure having a round cross section.

The present invention also provides a method for manufacturing light fixtures which comprises the following steps. At least four (4) modular panels are provided as discussed above with at least four (4) adjoining panels which include smooth side edges or tongues for insertion between the two spaced-apart lips of the modular panels. The modular panels and adjoining flat panels are connected together in an alternating fashion. The ultimate cross section of the light fixture will depend upon the width of the adjoining panels and the width or length of curvature of the modular panels. For example, wider adjoining panels of a uniform size and smaller modular panels will result in a light fixture having a substantially square cross section with rounded edges. In another embodiment, wider curved modular panels combined with two relatively wide adjoining panels and two relatively narrow adjoining panels will result in a light fixture having an oval-shaped cross section.

As discussed below and shown in the figures, light fixtures having a wide variety of shapes and styles can be provided utilizing the modular panels and methods of the present invention.

Therefore, it is an object of the present invention to provide a modular panel that can be used in a wide variety of light fixture sizes and styles.

Another object of the present invention is to provide an improved method of manufacturing light fixtures utilizing modular panels.

Another object of the present invention is to provide a single modular panel that may be used in a wide variety of light fixture shapes and styles.

Another object of the present invention is to provide methods of manufacturing light fixtures at lower costs.

Still another object of the present invention is to provide improved methods of utilizing modular components in the manufacture of light fixtures.

Other objects and advantages of the present invention will be apparent to those skilled in the art upon reference to the accompanying detailed description of the presently preferred embodiments and upon reference to the drawings.

BRIEF DESCRIPTION OF THE DRAWINGS

FIG. 7 is an exploded view of four (4) modular panels of a third embodiment of the present invention.

FIG. 8 is a perspective view of a light fixture incorporating four (4) of the modular panels illustrated in FIG. 7.

FIG. 9 is a light fixture incorporating four (4) of the modular panels illustrated in FIG. 7.

FIG. 10 is an end view of a third embodiment of a modular panel made in accordance with the present invention.

FIG. 11 is an end view of a light fixture incorporating four (4) of the modular panels illustrated in FIG. 10.

FIG. 14 is a partial perspective view of a light fixture fabricated from four (4) modular panels illustrated in FIG. 7.

FIG. 15 is a partial end view of a fifth embodiment of a modular panel and two adjoining side panels made in accordance with the present invention.

FIG. 16 is a partial end view of a sixth embodiment of a modular panel and two adjoining side panels made in accordance with the present invention.

FIG. 17 is a partial end view of a seventh embodiment of a modular panel and two adjoining side panels made in accordance with the present invention.

FIG. 18 is a partial end view of an eighth embodiment of a modular panel and two adjoining side panels made in accordance with the present invention.

FIG. 19 is a partial end view of a ninth embodiment of a modular panel and two adjoining side panels made in accordance with the present invention.

FIG. 20 is a partial end view a tenth embodiment of a modular panel and two adjoining side panels made in accordance with the present invention.

FIG. 21 is a partial side view of five different male ends of adjoining side panels that can be coupled with side edges of various embodiments of the modular panels of the present invention.

It should be understood that the drawings are not necessarily to scale and that the embodiments are sometimes illustrated by diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
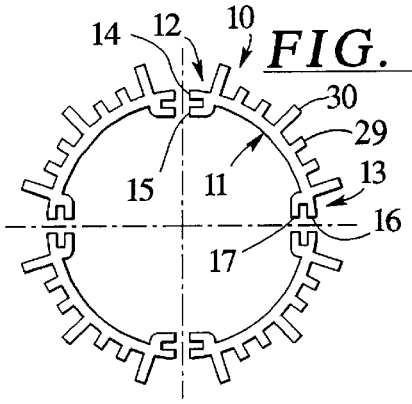
FIG. 1 is an end view of four (4) modular panels made in accordance with the present invention.
Figure 2:
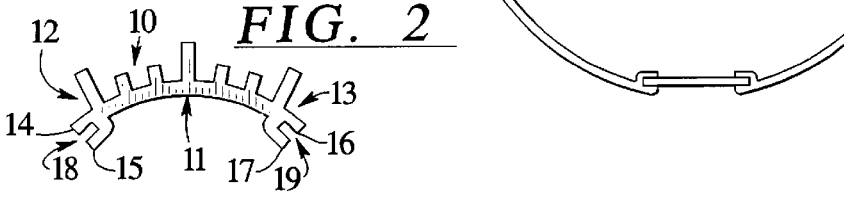
FIG. 2 is an end view of a modular panel illustrated in FIG. 1.

As illustrated in FIGS. 1 and 2, a modular panel 10 is provided which includes a main panel 11 having an arched or curved cross section with two side edges 12, 13. Each side edge or side 12, 13 terminates in a receiving area defined by two spaced-apart lips 14, 15 and 16, 17. The spaced-apart lips 14, 15, 16, 17 define elongated slots or grooves 18 and 19 respectively that extend along the length of the panel 10. The slots 18, 19 accommodate an edge or a tongue of an adjoining part or structure such as those shown at 21 and 22 in FIG. 3 or at 23 in FIG. 5.

In the embodiment illustrated in FIGS. 1–4, the panels 10 include a plurality of upwardly protruding fins shown generally at 29 and 30. The fins 29, 30 may serve two separate functions. First, the fins 29, 30 may serve to strengthen or add structural rigidity to the panels 10. The fins 29, 30 may also be used to scatter light passing through the panels 10 in the event the panels 10 are used as a lens for a fixture.

Figure 3:
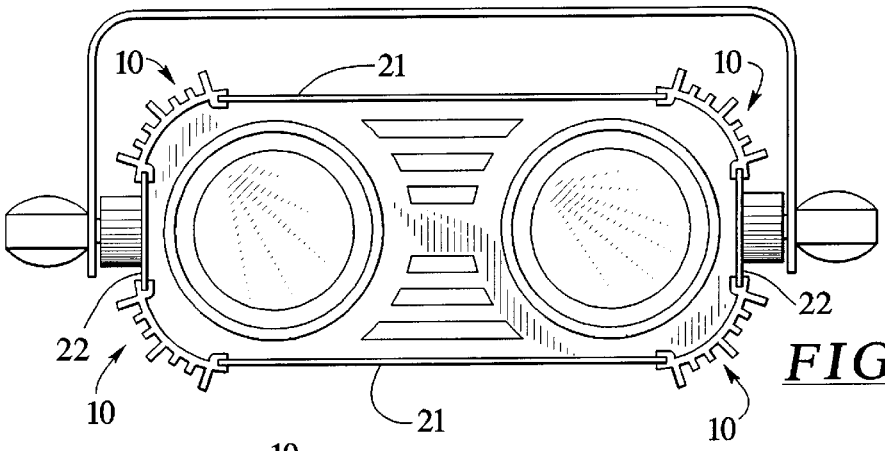
FIG. 3 is an end view of a light fixture utilizing four (4) of the modular panels illustrated in FIG. 1.
Figure 4:
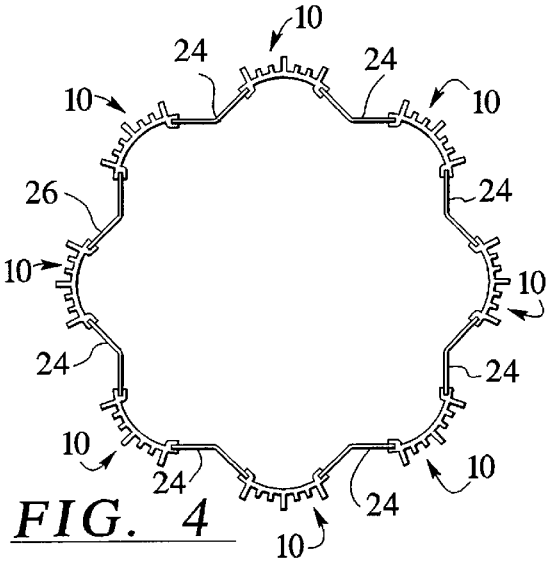
FIG. 4 is an end view of a light fixture utilizing eight (8) of the modular panels illustrated in FIG. 1.
Figure 5:
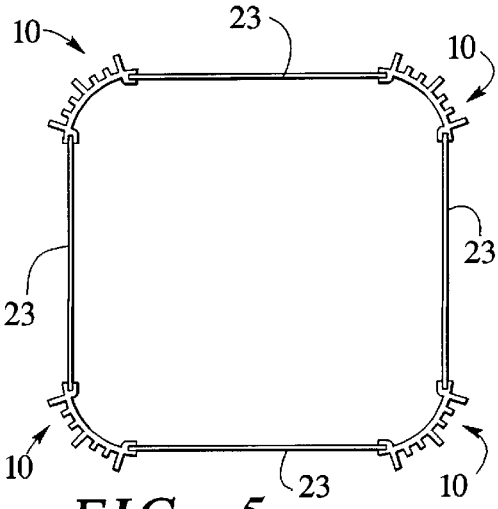
FIG. 5 is an end view of a light fixture utilizing four (4) modular panels illustrated in FIG. 1.

The versatility of the panels shown at 10 is illustrated in FIGS. 3–5. Specifically, if the panels 10 are used with a combination of wider adjoining panels 21 and narrower panels 22 as shown in FIG. 3, an elongated rectangular cross sectional design may be obtained. As illustrated in FIG. 5, if the adjoining panels shown at 25 are of a uniform width, a light fixture having a relatively square cross section is obtained. In stark contrast, if a panel 24 having a V-shape is employed, an octagon shaped fixture as illustrated in FIG. 4 may be obtained.

Figure 6:
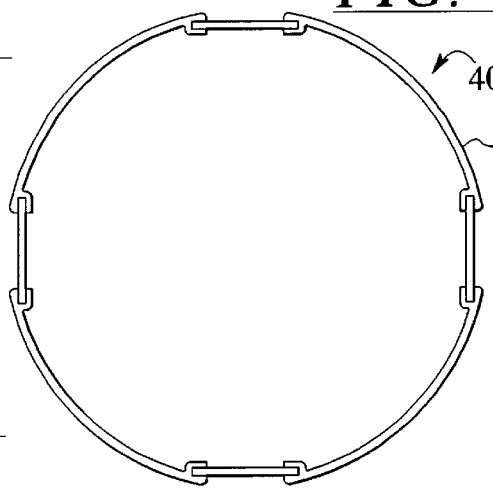
FIG. 6 is an end view of a light fixture utilizing four (4) modular panels of a second embodiment of the present invention.

As illustrated in FIGS. 6–13, the modular panels may be provided in a variety of shapes or widths. Specifically, as illustrated in FIG. 6, a panel 40 may be provided with a longer arc and a lack of fins to provide a smooth exterior surface 41. As illustrated in FIG. 7, panels such as those illustrated at 50 may be provided with a longer central upwardly protruding fin 51 and shorter adjacent fins 52. Also, a hollow tube or rib 53 may be provided which is mounted on the inside surface 54 of the fin 50 to provide structural support as well as a means for attaching an end plate (not shown). The hollow tube 53 will normally extend along the length of the panel 50 because the panels 50, as well as the remaining panels described herein, are preferably fabricated using an extrusion process.

As illustrated in FIGS. 8 and 9, the panels 50 may be incorporated into light fixtures 60 and 61 having a relatively square cross section or they may be incorporated into light fixtures having the cross sections shown in FIGS. 3–6. Further, it is anticipated that four (4) panels may be adjoined directly together to provide a light fixture having a round cross section as illustrated in FIGS. 13 and 14.

Figure 12:
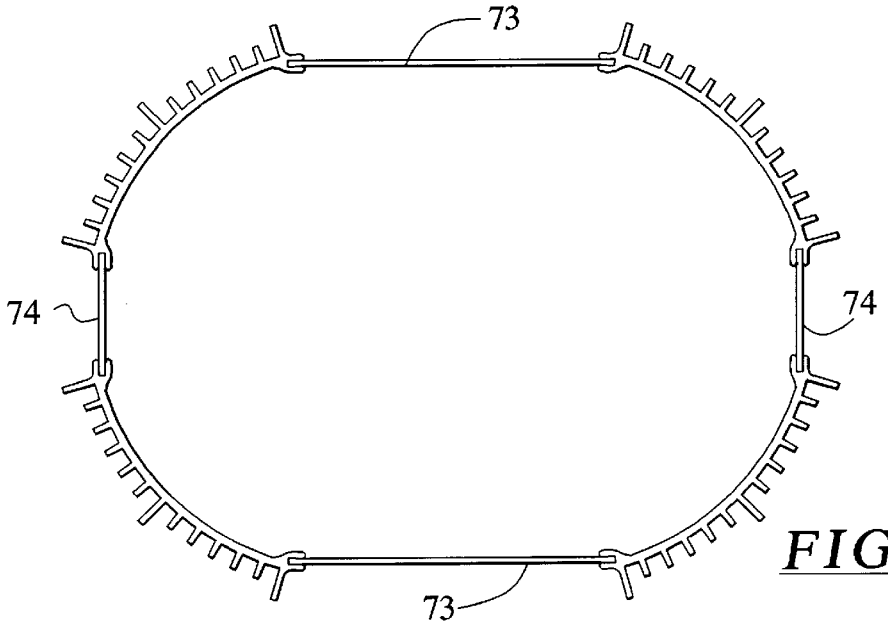
FIG. 12 is an end view of another light fixture incorporating four (4) of the modular panels illustrated in FIG. 10.
Figure 11A:
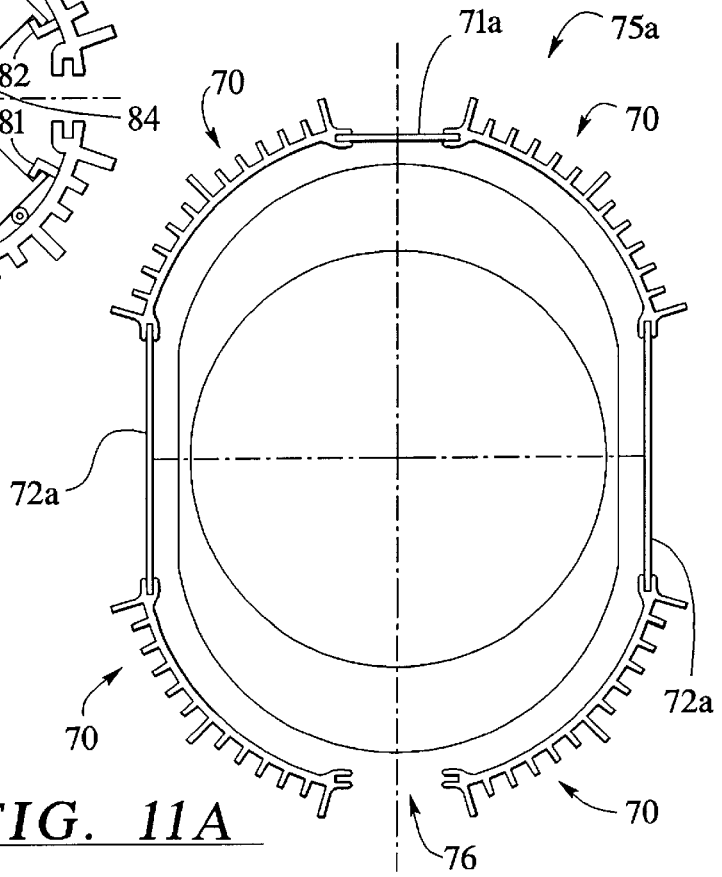
FIG. 11A is an end view of a light fixture incorporating four (4) of the modular panels illustrated in FIG. 10.

As illustrated in FIG. 10, a panel 70 having a wider width or longer arc than the panels illustrated in FIGS. 1 and 7 may be provided which can be employed with adjoining panels 71 and 72 to provide a light fixture having the cross section illustrated in FIG. 11 or adjoining panels 73, 74 to provide the light fixture having the cross section illustrated in FIG. 12. In addition, as illustrated in FIG. 11A, the modular panel 70 of the present invention may be incorporated into fixture 75*a* which directs light in a specific direction, such as toward a wall, by providing an opening shown at 76 in one side of the fixture 75*a*. In the embodiment illustrated in FIG. 11A, a narrow panel 71*a* has been removed. In an alternative embodiment, a clear panel may be used to replace the removed panel 71*a*.

Figure 13:
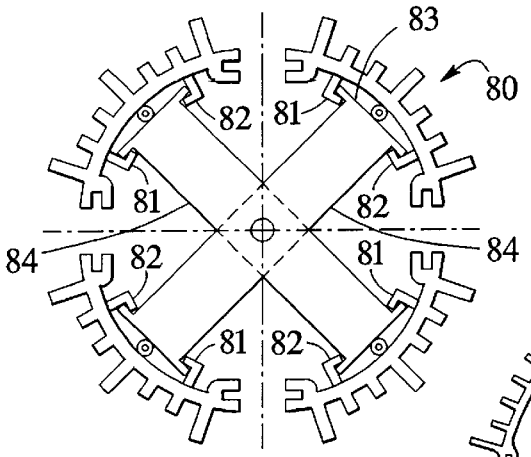
FIG. 13 is an end view of a light fixture incorporating four (4) modular panels of a fourth embodiment of the present invention.

In a further embodiment illustrated in FIG. 13, panels such as those shown at 80 are provided with a pair of brackets 81, 82 disposed on the inside surface 83. The brackets 81, 82 serve to accommodate the cross bars shown at 84. One or more cross bars such as those shown at 84 in FIG. 13 may be provided to add structural support to a light fixture as well as to provide a supporting structure for the internal workings of a light fixture such as a balast, fuse wiring or other functional elements.

As illustrated in FIG. 15, a panel 90 may be provided with side edges 91, 92 that include grooves in the form of L-shaped receiving areas for receiving the adjoining panels 93 having an L-shaped edge. The adjoining panels 93 are further illustrated in FIG. 21.

As illustrated in FIG. 16, a modular panel 100 may be provided with similar side edges 101, 102 that include L-shaped receiving areas for receiving the adjoining panels 93 that include the L-shaped male edges. The side edges 101, 102 are disposed inward from the inside surface 103 of the panel 100. In contrast, the L-shaped receiving areas of the side edges 91, 92 of the panel 90 as illustrated in FIG. 15 are disposed outward from the inside surface of the panel 90.

FIG. 17 illustrates a panel 110 with side edges 111, 112 that feature triangular-shaped receiving areas for receiving the side panels 113 that feature the triangular-shaped male edges as further illustrated in FIG. 21. FIG. 18 features a panel 120 with side edges 121, 122 with receiving areas having a round or circular cross section for receiving the round or beaded male edges of the adjoining side panels 123 (see also FIG. 21). FIG. 19 features a panel 130 with side edges 131, 132 having T-shaped receiving areas for receiving the side panels 133 having a T-shaped male end (see also FIG. 21). FIG. 20 features a modular panel 140 with side edges 141, 142 with receiving areas having a V-shaped cross section for receiving the panels 143 having a V-shaped male end (see also FIG. 21).

In the embodiments illustrated in FIGS. 15–21, the adjoining side panels are effectively trapped in the side edges of the modular panels. This positive entrapping relationship between the side edges of the modular panels and the adjoining panels ensures that the light fixture will not come apart during or after assembly of the light fixture.

By providing a modular panel may be easily connected or interlocked with adjoining panels, the present invention provides a way for a manufacture to use a single modular panel in a variety of light fixture styles and sizes. As noted above, in the past, manufacturers could use only one extruded component per light style and/or light size. Only the length of a light fixture could be modified, if the components were from manufactured using an extrusion process. If the design or style of the fixture was changed, a new tool would have to be designed and built.

In contrast, in accordance to the present invention, a single modular panel may be incorporated in a variety of light fixture designs and styles. Hence, the manufacturer can offer a variety of designs and styles, without incurring new tooling costs for each new design and style. In addition, because tooling requirements are minimized, manufacturers are able to introduce new designs and styles in shorter time frame and with greater frequency.

Although only eight embodiments of the present invention have been illustrated and described, it will at once be apparent to those skilled in the art that variations may be made within the spirit and scope of the present invention. Accordingly, it is intended that the scope of the invention be limited solely by the scope of the hereafter appended claims and not by any specific wording in the foregoing description.

What is claimed is:

1. A light fixture housing comprising:

a plurality of modular panels, each modular panel connected between two parts of the light fixture thereby forming a housing with a closed cross section, each of said modular panels comprising an elongated main panel comprising an arcuate outer surface defining an arcuate cross section, the arcuate outer surface being disposed between two opposing elongated side edges, each side edge comprising a receiving area extending along each side edge for mateably receiving an edge of one of said parts, the outer surface comprising a plurality of spaced apart outwardly protruding fins that extend radially outward from the housing, the fins further being disposed parallel to the side edges and evenly spaced across the outer surface between the side edges.

2. The light fixture of claim 1 wherein the main panel of each of said modular panels has a curved cross section between the two opposing elongated side edges.

3. The light fixture of claim 1 wherein the main panel of each of said modular panels further comprises an inside surface and two opposing ends, the inside surface comprising a rib extending between the two ends.

4. The light fixture of claim 1 wherein the main panel of each of said modular panels further comprises an inside surface and two opposing ends, the inside surface comprising a hollow rib extending between the two ends.

5. A method of manufacturing light fixture housings comprising the following steps:

providing at least four modular panels including a first, second, third and fourth modular panels, each of said modular panels comprising an elongated main panel comprising two opposing elongated sides, each side comprising a receiving area extending along each side, the main panel of each of said modular panels further comprising an inside surface and two opposing ends, the inside surface comprising a hollow rib extending between the two ends, providing at least four parts including a first, second, third and fourth parts, each of said parts comprising two opposing side edges, connecting the first and second modular panels together by inserting one of the side edges of the first part in the receiving area of one of the sides of the first modular panel and inserting the other of said sides edges of the first part in the receiving area of one of the sides of the second modular panel, connecting the second and third modular panels together by inserting one of the side edges of the second part in the receiving area of the other side of the second modular panel and inserting the other of said sides edges of the second part in the receiving area of one of the sides of the third modular panel, connecting the third and fourth modular panels together by inserting one of the side edges of the third part in the receiving area of the other side of the third modular panel and inserting the other of said sides edges of the third part in the receiving area of one of the sides of the fourth modular panel, connecting the fourth and first modular panels together by inserting one of the side edges of the fourth part in the receiving area of the other side of the fourth modular panel and inserting the other of said sides edges of the third part in the receiving area of the other of the sides of the first modular panel.

6. A method of manufacturing light fixture housings comprising the following steps:

providing at least four modular panels including a first, second, third and fourth modular panels, each of said modular panels comprising an elongated main panel comprising an arcuate outer surface defining an arcuate cross section, the arcuate outer surface being disposed between two opposing elongated sides, each side comprising a receiving area extending along each side, the outer surface comprising a plurality of spaced apart outwardly protruding fins that extend radially outward from the housing, the fins further being disposed parallel to the side edges and evenly spaced across the outer surface between the side edges, providing at least four parts including a first, second, third and fourth parts, each of said parts comprising two opposing side edges, connecting the first and second modular panels together by inserting one of the side edges of the first part in the receiving area of one of the sides of the first modular panel and inserting the other of said sides edges of the first part in the receiving area of one of the sides of the second modular panel to form a housing with a closed cross section, connecting the second and third modular panels together by inserting one of the side edges of the second part in the receiving area of the other side of the second modular panel and inserting the other of said sides edges of the second part in the receiving area of one of the sides of the third modular panel, connecting the third and fourth modular panels together by inserting one of the side edges of the third part in the receiving area of the other side of the third modular panel and inserting the other of said sides edges of the third part in the receiving area of one of the sides of the fourth modular panel, connecting the fourth and first modular panels together by inserting one of the side edges of the fourth part in the receiving area of the other side of the fourth modular panel and inserting the other of said sides edges of the third part in the receiving area of the other of the sides of the first modular panel.

7. The method of claim 6 wherein the main panel of each of said modular panels has a curved cross section between the two opposing elongated side edges.

8. The method of claim 6 wherein the main panel of each of said modular panels further comprises an inside surface and two opposing ends, the inside surface comprising a rib extending between the two ends.

9. The method of claim 6 wherein the main panel of each of said modular panels further comprises an inside surface and two opposing ends, the inside surface comprising a hollow rib extending between the two ends.

* * * * *